US007469931B2

(12) United States Patent
Biester

(10) Patent No.: US 7,469,931 B2
(45) Date of Patent: Dec. 30, 2008

(54) CONNECTION DEVICE

(75) Inventor: Klaus Biester, Wienhausen (DE)

(73) Assignee: Cameron International Corporation, Houston, TX (US)

( * ) Notice: Subject to any disclaimer, the term of this patent is extended or adjusted under 35 U.S.C. 154(b) by 91 days.

(21) Appl. No.: 10/525,860

(22) PCT Filed: Sep. 1, 2003

(86) PCT No.: PCT/EP03/09700

§ 371 (c)(1),
(2), (4) Date: Feb. 25, 2005

(87) PCT Pub. No.: WO2004/020782

PCT Pub. Date: Mar. 11, 2004

(65) Prior Publication Data

US 2005/0206162 A1 Sep. 22, 2005

(30) Foreign Application Priority Data

Aug. 30, 2002 (DE) ..... 202 13 393 U

(51) Int. Cl.
*F16L 35/00* (2006.01)

(52) U.S. Cl. ..... 285/18; 285/920; 285/412

(58) Field of Classification Search ..... 285/324, 285/412, 322, 323, 920, 34, 35, 123.1, 18; 166/338, 345, 348; 403/109.5, 314, 374.3, 403/374.4, 409.1; 292/149, 176
See application file for complete search history.

(56) References Cited

U.S. PATENT DOCUMENTS

| | | | | | |
|---|---|---|---|---|---|
| 3,338,596 | A | * | 8/1967 | Knox | 285/18 |
| 3,999,782 | A | * | 12/1976 | Shotbolt et al. | 285/18 |
| 4,209,270 | A | * | 6/1980 | Billingsley | 405/224.2 |
| 4,433,859 | A | * | 2/1984 | Driver et al. | 285/34 |
| 4,526,206 | A | * | 7/1985 | Ayers | 138/89 |
| 4,708,376 | A | * | 11/1987 | Jennings et al. | 285/920 |
| 4,730,853 | A | * | 3/1988 | Gjessing | 285/18 |
| 5,941,574 | A | | 8/1999 | Hamilton et al. | |

FOREIGN PATENT DOCUMENTS

| | | |
|---|---|---|
| WO | WO01/36785 | 5/2001 |
| WO | WO02/36932 | 5/2002 |

OTHER PUBLICATIONS

International Search Report for Application No. PCT/EP03/09700 dated 02/01/2004 (3 p.).

* cited by examiner

*Primary Examiner*—Aaron M Dunwoody
(74) *Attorney, Agent, or Firm*—Conley Rose, P.C.

(57) ABSTRACT

A connection device for connecting a tubular member to another member comprises a clamp ring, which is arranged in an inner bore of an outer housing, and includes a plurality of clamping fingers which are deflectable essentially in radial direction relative to the inner bore and a deflecting bushing which is displaceable by at least one driving means in axial direction of the inner bore between a stand-by position and a deflecting position. The deflecting bushing in its deflecting position deflects the clamping fingers radially inwardly. The driving means comprises a rotatable, axially not displaceable spindle along which the deflecting bushing is movable.

25 Claims, 2 Drawing Sheets

CONNECTION DEVICE

CROSS-REFERENCE TO RELATED APPLICATIONS

This application is a National Phase entry of PCT Application No. PCT/EP2003/009700 filed 1 Sep. 2003 which claims priority to German Application No. 202 13 393.1 filed 30 Aug. 2002; both of which are incorporated herein by reference. This application is related to the following applications: PCT Application No. PCT/EP2003/009701 filed 1 Sep. 2003 which claims priority to German Application No. 202 13 391.5 filed 30 Aug. 2003; PCT Application No. PCT/EP2003/009698 filed 1 Sep. 2003 which claims priority to German Application No. 202 13 365.6 filed 30 Aug. 2002; PCT Application No. PCT/EP2003/009697 filed 1 Sep. 2003 which claims priority to German Application No. 202 13 389.3 filed 30 Aug. 2002; PCT Application No. PCT/EP2003/009696 filed 1 Sep. 2003 which claims priority to German Application No. 202 13 364.8 filed 30 Aug. 2002; PCT Application No. PCT/EP2003/009699 filed 1 Sep. 2003 which claims priority to German Application No. 202 13 388.5 filed 30 Aug. 2002; and U.S. application Ser. No. 10/836,559 filed 30 Apr. 2004.

STATEMENT REGARDING FEDERALLY SPONSORED RESEARCH OR DEVELOPMENT

Not applicable.

BACKGROUND OF THE INVENTION

The present invention relates to a connection device for connecting a tubular member to another member, the connection device comprises a clamp ring which is arranged in an inner bore of an outer housing and includes a plurality of clamping fingers which are deflectable essentially in a radial direction relative to the inner bore, and a deflecting bushing which is displaceable by at least one driving means in an axial direction of the inner bore between a stand-by position and a deflecting position, by which deflecting a bushing in its deflecting position, the clamping fingers are radially inwardly deflected.

Such a connection device is known in practice and serves, for instance, to connect risers, or the like, to a blowout preventer (BOP), a valve, a throttle, or the like, especially in the field of gas and oil production. The connection device is connected at one end to the tubular member and is attached with its other end onto a corresponding tubular connecting piece, or the like, of the other member. By displacement of the deflecting bushing arranged in an inner bore of an outer housing of the connection device, i.e. from a stand-by position into a deflecting position, elastically deflectable clamping fingers of a clamp ring, which is also arranged in the inner bore, are deflected and pressed onto an outside of the connecting piece, or the like, of the other member. This pressing operation establishes a connection to the other member and also effects a corresponding sealing. Such connection devices are particularly used at places where high pressures are arising, where great strength and stiffness are needed with respect to a load path led through the connection device, and whenever the established connection must be correspondingly tight, e.g., when used below sea level and, in particular, on the sea bed.

In the case of the connection device known from practice, the deflecting bushing is displaced via a hydraulically operated driving means. The driving means is essentially designed as a hydraulic cylinder with an extensible piston, The deflecting bushing is fastened to an end of the piston accordingly.

The prior-art connection device has the drawback that the adjustment of the hydraulic driving means and thus of the deflecting bushing can only be controlled under great efforts. A fine setting or displacement of the deflecting bushing is normally not possible.

It is therefore the object of the present invention to improve a connection device of the type indicated above in such a way that an exactly reproducible displacement of the deflecting bushing is possible by simple constructive measures and without high costs, which also permits a controlled fine setting.

SUMMARY OF THE INVENTION

Improving a connection device in such a way that an exactly reproducible displacement of the deflecting bushing is possible by simple constructive measures and without high costs, which also permits a controlled fine setting, is achieved according to a connection device for connecting a tubular member to another member that comprises a clamp ring arranged in an inner bore of an outer housing, where the clamp ring comprises a plurality of clamping fingers which are deflectable essentially in a radial direction relative to the outer housing inner bore. The connection device also includes a deflecting bushing which is displaceable by at least one driving means in an axial direction of the inner bore between a stand-by position and a deflecting position, the clamping fingers being radially inwardly deflected when the deflecting busing is in the deflecting position. The driving means comprises a rotatable, axially not displaceable spindle along which said deflecting bushing is movable.

Since the deflecting bushing is movable along a rotatable spindle, the displacement thereof between a stand-by position and a deflecting position can be controlled in a very fine manner, resulting in corresponding displacements of the deflecting bushing by corresponding rotations of the rotatable spindle. Although the rotatable spindle is supported such that it is rotatable, it is not axially displaceable. The rotatable spindle is a component that is simple in principle and can easily be controlled by a corresponding driving device with respect to its rotation and also within the range of relatively small rotations.

To be able to move the deflecting bushing in a simple way along the rotatable spindle, the deflecting bushing may comprise a displacement nut arranged on the rotatable spindle, which upon rotation of the rotatable spindle is movable in axial direction.

The displacement nut may be made integral with the deflecting bushing. To simplify the assembly of deflecting bushing and rotatable spindle, the displacement nut can be detachably secured to the drive bushing.

A simple possibility of securing the displacement nut to the deflecting bushing can be seen in the measure that the deflecting bushing comprises an annular flange which projects particularly on a bushing end radially outwards and includes at least one mounting bore for the displacement nut. The displacement nut can be easily inserted into the mounting bore and detachably secured at said place. The diameter of the mounting bore can be chosen to have such a large size that the deflecting bushing with its mounting bore can be moved easily along the rotatable spindle until the displacement nut is arranged in the mounting bore.

In one embodiment, it is also possible to design the displacement nut as a recirculating ball nut which is arranged on the rotatable spindle. A gear ratio step up or a gear ratio reduction can thus be accomplished in an easy way between rotation of the rotatable spindle and displacement of the recirculating ball nut.

To reliably support the rotatable spindle for receiving corresponding loads, the rotatable spindle may be rotatably supported in a recirculating ball nut arranged on an inner wall of the outer housing. Said recirculating ball nut supports the rotatable spindle and can additionally be arranged with respect to the recirculating ball nut or displacement nut of the deflecting bushing.

To simplify the construction of the connection device and to be able to introduce the forces directly into the outer housing at the same time, the recirculating ball nut may be made integral with the outer housing.

The displacement nut can also be designed such that it extends at both sides of the recirculating ball nut secured to the outer housing and is movable accordingly along the rotatable spindle. As a rule, it is easier in constructive terms and sufficient for the displacement device according to the invention when the displacement nut is movable at one side relative to the recirculating ball nut along a first section of the rotatable spindle.

For a further stabilization of the rotatable spindle, it may be of advantage when the rotatable spindle has a second section opposite to the displacement nut relative to the recirculating ball nut, which projects from the recirculating ball nut and is optionally supported to be separately rotatable.

To press the deflecting bushing in an improved way along its whole length towards the clamp ring, a deflecting nut may be supported to be displaceable in an axial direction on the rotatable spindle and particularly on the second section thereof. The deflecting bushing is supported by the deflecting nut accordingly on its outside opposite to the clamp ring, so that the deflection of the clamping fingers towards the other member is ensured in the stand-by position of the deflecting bushing.

To support not only the deflecting bushing, but optionally also to press it towards the clamp ring, the deflecting nut may comprise at least one collet and a wedge section facing an outer surface of the deflecting bushing. Upon a corresponding displacement of the deflecting nut, the wedge section gets into contact with a mating wedge on the outer surface of the deflecting bushing and, when the two wedge surfaces are sliding along one another, it can press a section of the deflecting bushing against the clamping fingers for the elastic deflection of said fingers. Furthermore, it is ensured by the wedge surfaces, that are inclined relative to one another, that the wedge section and a corresponding portion of the deflecting bushing can be disengaged easily when the deflecting bushing is to be moved back into its stand-by position.

To be able to construct the corresponding deflecting nut in an easy manner, the wedge section may be formed as part of an outer surface of a deflecting body mounted on the collet in a particularly detachable manner.

Since the deflecting bushing moves relative to the recirculating ball nut arranged on the outer housing and might get into contact with the same, it is regarded as being beneficial to an easy displacement of the deflecting bushing when an anti-friction facing or coating is optionally arranged at least on a side of the recirculating ball nut facing the outer surface of the deflecting bushing.

For a simplified arrangement and support and for connection to the driving device, it may be regarded as an advantage when the rotatable spindle is rotatably supported at its bearing end on the outer housing and is drive-connected at its drive end to at least one motor. Of course, it is also possible that e.g. the drive force is not transmitted via an end of the rotatable spindle, but in the first or second section, to said spindle through a corresponding drive connection to the motor.

To achieve a corresponding speed reduction of the rotation of the rotatable spindle in comparison with the rotation of the motor, a reducing gear unit, particularly a so-called harmonic drive, may be arranged between drive end and motor. A harmonic drive is known per se and consists essentially of three components. The first component is a ring which is fixed as a rule and includes an inner toothing. The second component is a cup-shaped bushing with an outer toothing which is in engagement with the inner toothing of the ring. The cup-shaped bushing is elastically deformable, so that only opposite portions of the bushing are essentially in engagement with the inner toothing of the fixed ring component. For the elastic deformation of the bushing, said member has arranged therein a so-called shaft-driven generator which in the embodiment according to the invention is drive-connected to the motor. By contrast, the cup-shaped bushing is motion-connected to the rotatable spindle.

To move, if necessary, deflecting nut and displacement nut at different axial speeds upon rotation of the rotatable spindle along said spindle, the pitches of a first and second section of the rotatable spindle may be different. This offers e.g. the possibility that first of all the contact of the wedge surfaces is largely eliminated by displacing the deflecting nut, while the displacement nut has only moved to a slight degree. It is only upon removal of the wedge surface contact that the deflecting bushing will then be displaced further by means of the displacement nut.

It should be noted that displacement nut and deflecting nut may also be made integral, e.g. as a recirculating ball nut, in this case the recirculating ball nut which is secured to the outer housing can also be omitted.

To prevent a possible reverse rotation of the rotatable spindle and thus a detachment of the other member by detachment of the clamping fingers upon failure of the power supply to the motor, the gearing consisting of rotatable spindle and recirculating ball nut may also be made self-locking.

To guarantee also in case of a displacement of the deflecting bushing into the stand-by position that the clamp ring might not be released and fall out of the connection device, a cam or cam ring may project approximately centrally in the axial direction of the deflecting bushing, the cam or cam ring being essentially in contact with an outer surface of the clamp ring. The cam guarantees at least that the clamp ring remains in its position inside the connection device also in cases where the clamping fingers are not deflected in a radial direction inwards.

To be able to use less powerful motors and thus motors of smaller sizes, a plurality of motors, i.e. two, three, four, or more, especially electric motors, may be arranged on an output shaft which is motion-connected to the reducing gear unit. Thanks to the use of several motors, these are relatively compact, so that the connection device has also a compact construction on the whole.

Furthermore, the use of a plurality of motors ensures that upon failure of one, two or more motors, at least one motor or also several motors can be used for the further rotation of the rotatable spindle.

It should be noted that it is of course possible to use several rotatable spindles with a construction as has been described above in the connection device according to the invention, said several drive devices being normally equally spaced apart from one another in the circumferential direction of the outer housing. The rotatable spindles can here be synchronized via a mechanical coupling means with respect to their rotary movements.

To assemble output shaft and motors in a simple way already beforehand and to be able to handle them jointly, output shaft and electric motors may be supported or arranged in a bore of an inner housing that is secured to the outer housing above all in a detachable manner. Optionally, the reducing gear unit is also arranged in said bore. Together with the installation of the inner housing in the outer housing, it is then ensured that a connection is simultaneously established between driving means and rotatable spindle, the rotatable spindle being possibly already arranged with the corresponding nuts in the outer housing.

The inner housing may be connected via a plurality of screw bolts to the outer housing. Furthermore, the inner housing may serve to secure the tubular member directly to said housing, a connection of the tubular member to the other member being established by a corresponding central bore of the inner housing.

To define an insertion position of the other member or of a connecting piece projecting therefrom, an abutment end of the inner housing facing away from the tubular member may be designed as an abutment for the other member inserted at least in part into the connection device.

To achieve not only a clamping action upon displacement of the deflecting bushing into its position of use by means of the elastically deflected clamping fingers, but also to establish a positive connection with the other member, the clamp bushing may be provided with radially inwardly projecting toothed rings which are in engagement with corresponding tooth receiving recesses of the inner housing and/or of the other member or can be brought into engagement by the action of the deflecting bushing. The engagement of toothed ring and tooth receiving recess of the inner housing serves, in particular in connection with the cam of the deflecting bushing, to hold the clamp ring in the connection device also in the absence of the other member.

To support the rotatable spindle also in the area of the reducing gear unit once again and to receive corresponding and possibly transmitted loads, a pinion may be arranged especially on the drive end of the rotatable spindles and is in engagement with a gear supported on the inner housing. This engagement of pinion and gear results in a lateral supporting of the rotatable spindle, particularly directly next to the reducing gear unit, and also in a mechanical coupling for synchronizing the rotary movements of two or more rotatable spindles.

Instead of a gear, the mechanical coupling means may also be formed by a chain, a toothed belt, or a gear set. Furthermore, there is the possibility of providing the coupling means at another place of the rotatable spindle and/or for coupling drive shafts. It should here be noted that when two or more rotatable spindles are arranged, it is possible that only one rotatable spindle is directly driven via a corresponding driving means, whereas the drive force can be transmitted to the remaining rotatable spindles via the mechanical coupling means.

BRIEF DESCRIPTION OF THE DRAWINGS

An embodiment of the invention will now be described in more detail with reference to the figures attached to the drawing, in which.

DETAILED DESCRIPTION OF THE PREFERRED EMBODIMENTS

Figure 1:
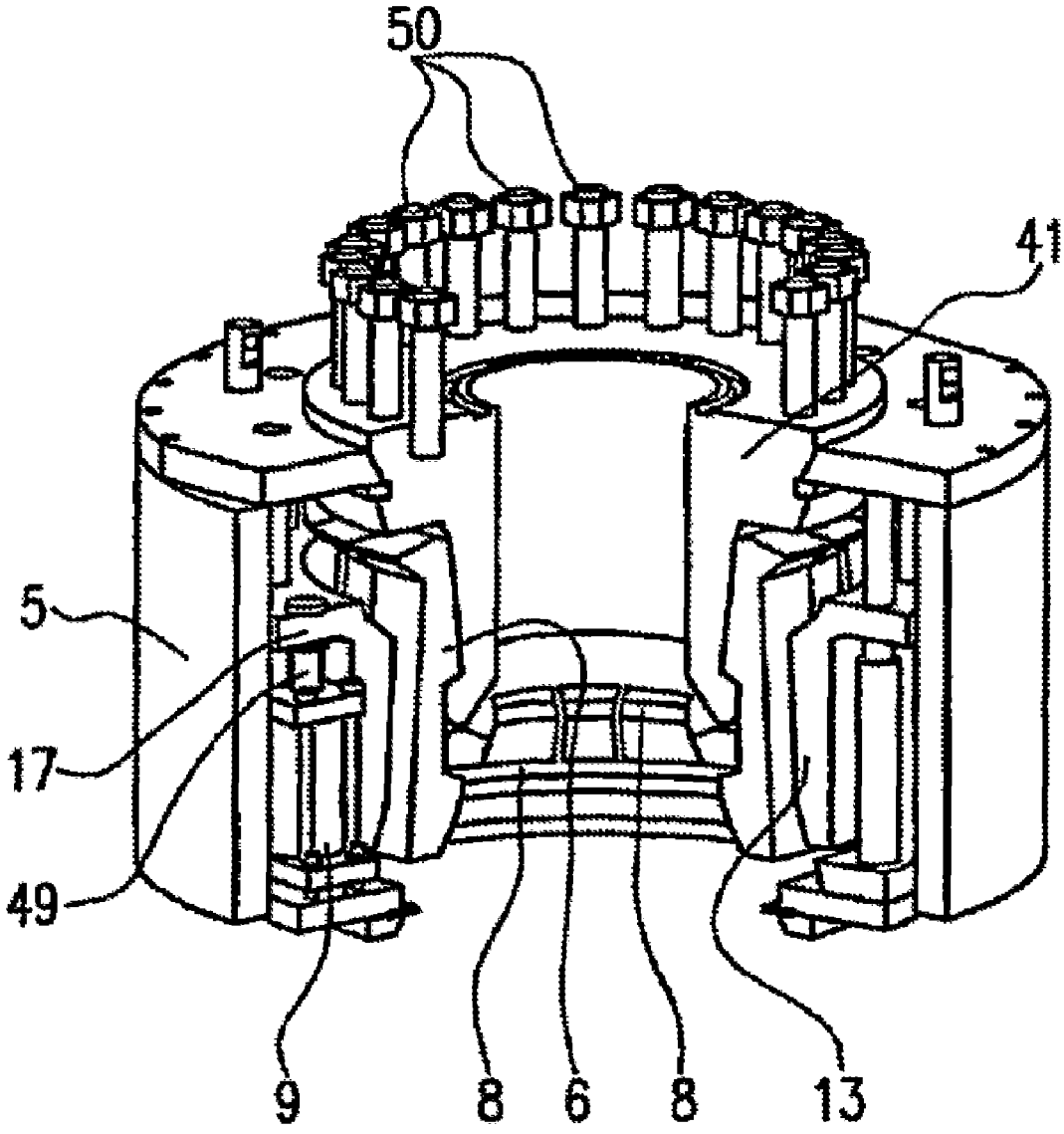
FIG. 1 Prior Art
FIG. 1 is a perspective and partly cut side view of a connection device as is known from practice.

FIG. 1 is a lateral, perspective and partly cut view of a known connection device 1. Said device comprises an outer housing 5 of an essentially cylindrical form. An inner housing 41 is arranged within the outer housing 5. At the end of the inner housing that is the upper one in FIG. 1, a plurality of screw bolts 50 are provided for securing a tubular member. The tubular member is detachably secured by means of the screw bolts to the inner housing 41 and is in communication with a corresponding central inner bore of the inner housing 41. Inner housing 41 and outer housing 5 have arranged thereinbetween a clamp ring 6 which in its lower portion comprises a plurality of clamping fingers 8. Said fingers are elastically deflectable in radial direction. Clamp ring 6 and outer housing 5 have arranged thereinbetween a deflecting bushing 13 displaceable in axial direction of the connection device 1 by means of at least one driving means 9. The driving means 9 is formed by at least one hydraulic cylinder, a radially outwardly projecting annular flange 17 of the deflecting bushing 13 being connected to an extensible piston 49 of the hydraulic cylinder. When the deflecting bushing is displaced out of its stand-by position into its deflecting position, it will press the clamping fingers 8 radially inwards, whereby a tubular member, which is inserted from below according to FIG. 1 and is also essentially tubular, is sealingly held in the connection device 1.

Such a connection device 1 serves to connect corresponding tubular members to other tubular members or also connecting pieces of other devices, particularly in the field of gas and oil production, such as blowout preventers, valves, throttles, or the like.

Figure 2:
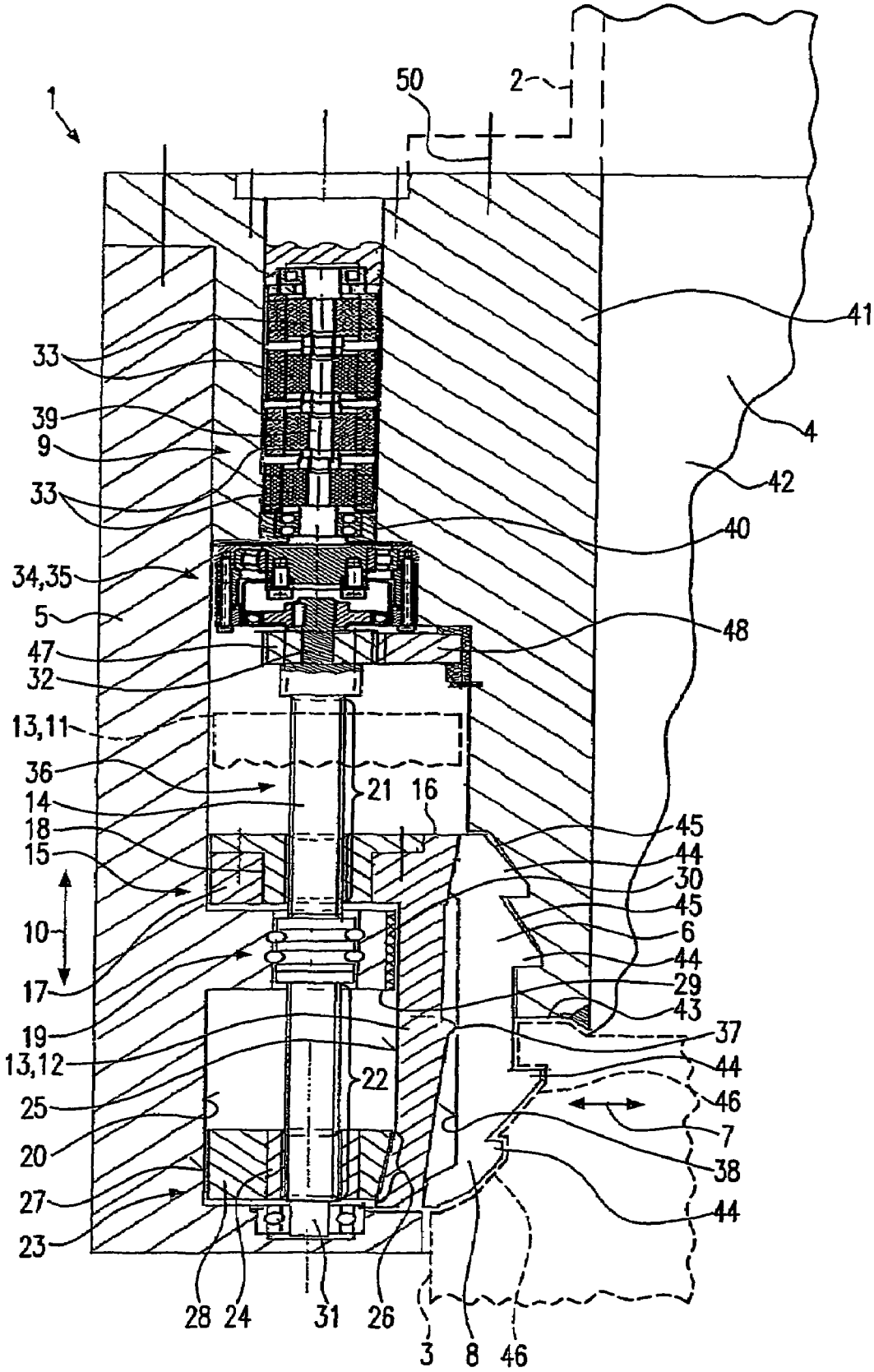
FIG. 2 is a longitudinal section through an embodiment of the connection device according to the invention.

FIG. 2 is a longitudinal section through an embodiment of a connection device 1 according to the invention.

In the connection device 1 according to the invention, an essentially cylindrical outer housing 5 has arranged therein an inner housing 41, which is also cylindrical. At least one driving means 9, a clamp ring 6, and a deflecting bushing 13 are arranged between the two housings 5, 41. The driving means 9 comprises a plurality of electric motors 33 which are arranged on an output shaft 39. Output shaft 39 and driving motors 33 are arranged in a bore 40 of the inner housing 41. The bore may be open at the upper end of the inner housing 41 according to FIG. 2 to gain access to the driving means 9 for the purpose of maintenance or exchange of parts of the driving means. At the upper end, the inner housing 41 is detachably connected to the outer housing, e.g. by screwing.

At both of its ends, the output shaft 39 is rotatably supported by corresponding bearings in bore 40 and projects from the bore. At its projecting end, it is connected to a so-called harmonic drive 35 as a reducing gear unit 34. Such a harmonic drive 35 essentially comprises a ring which is fixed as a rule and has an inner toothing, a flexible and cup-shaped bushing with an outer toothing, the outer toothing being in engagement with the inner toothing of the ring, and a so-called shaft-driven generator which is arranged inside the flexible bushing and presses opposite portions of the flexible bushing with its outer toothing into engagement with the inner toothing of the fixed ring.

In the illustrated embodiment, the shaft-driven generator is motion-connected to the output shaft 39, and the flexible bushing is motion-connected to a drive end 32 of a rotatable spindle 14. At the drive end 32, the rotatable spindle 14 farther comprises a pinion 47 which is meshing with a gear 48 supported on the inner housing 41.

The rotatable spindle 14 extends in an axial direction 10 or the longitudinal direction of the connection device 1. It has a first section 21 and a second section 22 that have rotatably supported thereinbetween the rotatable spindle 14 in a recirculating ball nut 19. The recirculating ball nut 19 is made integral with the outer housing 5 and projects from an inner wall 20 of the outer housing towards the inner housing 41. It is also possible that the recirculating ball nut 19 is designed as a separate part and is e.g. secured for the rotatable, but axially not displaceable, support of the rotatable spindle 14 to the inner wall 20.

In a first section 21 of the rotatable spindle 14, said spindle has arranged thereon a displacement nut 15, together with which the deflecting bushing 13 is displaceable between a stand-by position 1, see the broken-line illustration in FIG. 2, and a deflecting position 13 in axial direction 10. The displacement nut 15 is inserted into a mounting hole 16 of an annular flange 17, which radially projects outwards at the bushing end 16 of the deflecting bushing 13, and is detachably secured in said hole.

In the deflecting position 12, the displacement nut 15 is almost in contact with the recirculating ball nut 19. Said nut is provided with an antifriction coating 30, or the like, on its side 29 oriented towards an outer surface 25 of the deflecting bushing 13 to reduce friction between recirculating ball nut 19 and deflecting bushing 13.

In the second section 22 of the rotatable spindle 14 that is projecting opposite to the displacement nut 15 relative to the recirculating ball nut 19, a deflecting nut 23 is supported on the spindle. The deflecting nut 23 comprises a deflecting body 28 in which a collet 24 is arranged approximately in the center. The deflecting nut 23 is displaceable by means of the collet 24 in axial direction 10 along the rotatable spindle 14 upon the rotation thereof On an outer surface 27 facing the deflecting bushing 13, the deflecting body 28 comprises a wedge section 26 which is in contact with a corresponding wedge section on the outer surface 25 of the deflecting bushing 13 in the deflecting position 12 of the deflecting bushing 13 as shown in FIG. 2. The contact between the two wedge sections effects at least a support of the deflecting bushing 13 in said area.

Furthermore, the rotatable spindle 14 is rotatably supported underneath the deflecting nut 23 in the outer housing 5 by means of a corresponding bearing at its bearing end 31.

In the first and second sections 21, 22 of the rotatable spindle 14, the pitch of the rotatable spindle thread may be different, so that upon rotation of the rotatable spindle 14 by the driving means 9, displacement nut 15 and thus deflecting bushing 13 move at a different pace in comparison with the deflecting nut 23 in axial direction 10. This can e.g. take place such that due to a greater pitch, the deflecting nut 23 moves at a faster pace in the direction of recirculating ball nut 19 than does the displacement nut 15 on account of a smaller pitch in the first section 21 in the direction of stand-by position 11.

At its side facing the clamp ring 6, the deflecting bushing 13 is provided with at least a few inclined surfaces that, when deflecting bushing 13 is in deflecting position 12, bring the clamp ring 6, on the one hand, into engagement with the inner housing 41 and serve, on the other hand, to deflect the corresponding clamping fingers 8 towards the other member 3. Furthermore, the deflecting bushing 13 is provided approximately in its center with a cam 37 which supports the clamp ring 6 on its outer surface 38 such that, even if the deflecting bushing 13 is in the stand-by position 11, it does not disengage from the inner housing 41. The engagement between clamp ring 6 and inner housing 41 is established by at least two toothed rings 44 that project from the clamp ring 6 towards inner housing 41 and engage into corresponding tooth receiving recesses 45.

Two further toothed rings 44 are arranged in the clamp ring 6 below an abutment end 43 of the inner housing 41. Said toothed rings 44 engage into corresponding tooth receiving recesses 46 of the other member 3 when said member is inserted into the connection device 1. The insertion position of the other member 3 is here defined by the abutment of a front inserted end of the other member 3 with the abutment end 43 of the inner housing 41. A sealing means may additionally be arranged between inner housing 41 and other member 3.

Upon displacement of the deflecting bushing 13 out of its stand-by position 11 into the deflecting position 12, the clamping fingers 8 are elastically deflectable in radial direction 7 to the inside towards the inner bore 4 and thus for engagement of the toothed rings 44 with the tooth receiving recesses 46 of the other member 3. Thanks to this engagement, the other member 3 is both held and sealed in the connection device.

In an alternative embodiment of the connection device 1 according to the invention, displacement nut 15, recirculating ball nut 19, and deflecting nut 23 are made integral, so that there is no separate support of the rotatable spindle 14 approximately in the center by a recirculating ball nut 19 secured to the inner wall 20 of the outer housing 5. Instead of this, the deflecting bushing 13 is moved together with this single recirculating ball nut in axial direction 10 along the rotatable spindle 14. In a further embodiment of the connecting device, only displacement nut 15 and recirculating ball nut 19 are made integral, the deflecting nut 23 being still designed as a separate member that is separately displaceable along the rotatable spindle 14. In this instance, too, an approximately central support of the rotatable spindle 14 is omitted. However, it should be noted that the rotatable spindle 14 is also supported to some degree even in case of an integral design of recirculating ball nut 19 and adjustment nut 15 due to a slide contact of said integral component with the inner wall 20 of the outer housing 5.

In the illustrated embodiment, the drive means 9 comprises four electric motors 33. These serve the purpose of redundancy, so that even in case of failure of one or several motors 33, the rotatable spindle 14 can still rotate in a safe way. Furthermore, the number of the electric motors 33 serves to achieve a relatively lean construction of the connection device because due to the plurality of motors these may have a smaller power rating per motor and can thus be built with a correspondingly smaller size. Electric motors, such as servomotors or asynchronous motors, are used as motors 33.

Furthermore, it is possible to provide not only a drive means 9 with the further components according to FIG. 2, such as rotatable spindle 14, recirculating ball nut 19, reducing gear unit 34, etc., but also to arrange corresponding devices at two, three or more places in the circumferential direction of the connection device 1; see FIG. 1. In case of an arrangement of e.g. two of such assemblies, these are preferably arranged opposite the inner bore 4.

FIG. 2 shows a mechanical coupling means 51 in two variants for different embodiments. The one embodiment with pinion 47 and gear 48 has already been explained above. Instead of gear 48, which synchronizes the rotations of different rotatable spindles 14 and drive shafts 39, respectively, it is also possible to use a rotating chain, a rotating toothed belt, or also a gear set. With such a mechanical coupling means it is possible that only one of the rotatable spindles is connected to a driving means whereas the others are rotated via motion coupling.

In the other embodiment of the mechanical coupling means 51, a pinion 52 is arranged at an end of the drive shaft 39 and connected to the corresponding pinions of further drive shafts 39 via a toothed belt or a chain. It is again possible to realize the mechanical coupling means also by way of a gear set. Of course, it is possible to combine various embodiments of the mechanical coupling means with one another.

The function of the connection device 1 according to the invention shall now be explained in the following with reference to the figures:

A first tubular member 2 is preferably secured to the inner housing 41 via screw bolts 50; see FIGS. 1 and 2. Said tubular member 2 communicates with the inner bore 4. At the opposite end of the connection device 1, another member 3 is inserted that is also essentially tubular and projects, for instance, from a valve, a throttle, a blowout preventer, or the like. Said other member 3 is inserted to such an extent that it is in contact with the abutment end 43 of the inner housing 41. In this position, the deflecting bushing 13 is displaced out of its stand-by position 11 into the deflecting position 12 by actuating the driving means 9 and by correspondingly rotating the rotatable spindle 14. During this displacement, on the inside of the deflecting bushing 13 facing the clamping ring 6, corresponding inclined surfaces get into contact with corresponding inclined surfaces on the outer surface 38 of the clamp ring 6 and press said ring into further engagement with the inner housing 41 and into engagement with the other member 3. Said engagement is realized by toothed rings 44 which engage e.g. into tooth receiving recesses 45 of the inner housing 41 or, by deflecting the corresponding clamping fingers 8, into corresponding tooth receiving recesses 46 on the other member 3. The engagement of the corresponding toothed rings 44 is improved by the measure that virtually at least at two places the deflecting bushing 13 is supported on its outer surface 25, on the one hand, by displacement nut 15 in the first portion 21 of the rotatable spindle 14 and, on the other hand, by deflecting nut 23 in the second section 22 of the displacement spindle 14. By analogy, said engagement is disconnected at the same time by simultaneous displacement of displacement nut 15 and deflecting nut 23 or at least reduced with respect to the inner housing 41. To prevent the clamp ring from falling outwards, also when the deflecting bushing 13 is in its stand-by position 11, a cam or cam ring 37 is especially provided that is still holding the clamp ring 6 with the toothed rings 44 in the tooth receiving recesses 45 in the inner housing 41.

To prevent the rotatable spindle 14 from rotating automatically, if necessary, whereby the deflecting bushing 13 might be displaced towards its stand-by position 11, the gearing 36 consisting of recirculating ball nut 19 and rotatable spindle 14 is made self-locking.

The invention claimed is:

1. A connection device for connecting a tubular member to another member, said connection device comprising:

a clamp ring arranged in an inner bore of an outer housing and comprising a plurality of clamping fingers which are deflectable essentially in a radial direction relative to said inner bore;

a deflecting bushing which is displaceable by at least one driving means in an axial direction of said inner bore between a stand-by position and a deflecting position;

said clamping fingers being radially inwardly deflected when said deflecting bushing is in said deflecting position; and characterized in that said driving means comprises a rotatable, axially not displaceable spindle, said deflecting bushing being movable along said spindle.

2. The connection device according to claim 1, characterized in that said deflecting bushing comprises a displacement nut which is arranged on said rotatable spindle and which upon rotation of said rotatable spindle is movable in axial direction.

3. The connection device according to claim 1, characterized in that said displacement nut is detachably secured to said deflecting bushing.

4. The connection device according to claim 1, characterized in that said deflecting bushing comprises an annular flange radially projecting outwards particularly on a bushing end and including at least one mounting bore for said displacement nut.

5. The connection device according to claim 1, characterized in that said displacement nut is designed as a recirculating ball nut.

6. The connection device according to claim 1, characterized in that said rotatable spindle is rotatably supported in a recirculating ball nut arranged on an inner wall of said outer housing.

7. The connection device according to claim 1, characterized in that said recirculating ball nut is made integral with said outer housing.

8. The connection device according to claim 1, characterized in that said adjustment nut is movable at one side relative to said recirculating ball nut along a first section of said rotatable spindle.

9. The connection device according to claim 1, characterized in that said rotatable spindle comprises a second section opposite to said displacement nut relative to said recirculating ball nut.

10. The connection device according to claim 1, characterized in that a deflecting nut is adjustably supported in axial direction on said rotatable spindle and particularly on said second section.

11. The connection device according to claim 1, characterized in that said deflecting nut comprises at least one collet and a wedge section facing an outer surface of said deflecting bushing.

12. The connection device according to claim 1, characterized in that said wedge section is designed as part of an outer surface of a deflecting body which is mounted particularly detachably on said collet.

13. The connection device according to claim 1, characterized in that an antifriction facing or coating is arranged at least one side of said recirculating nut that is facing the surface of said deflecting bushing.

14. The connection device according to claim 1, characterized in that said rotatable spindle is rotatably supported at its support end on said outer housing and is drive-connected at its drive end to at least one motor.

15. The connection device according to claim 1, characterized in that a reducing gear unit, particularly a so-called harmonic drive, is arranged between drive end and motor.

16. The connection device according to claim 1, characterized in that pitches of said first and second section of said rotatable spindle are different.

17. The connection device according to claim 1, characterized in that the gearing consisting of rotatable spindle and recirculating ball nut is made self-locking.

18. The connection device according to claim 1, characterized in that a cam which is essentially in contact with an outer surface of said clamp ring projects approximately centrally in axial direction of said deflecting bushing.

19. The connection device according to claim 1, characterized in that a plurality of motors, particularly electric motors, are arranged on an output shaft which is motion-connected to said reducing gear unit.

20. The connection device according to claim 1, characterized in that said output shaft and said electric motors are supported or arranged in a bore of an inner housing which is secured particularly detachably in said outer housing.

21. The connection device according to claim 1, characterized in that said inner housing comprises a central bore and said tubular member is detachably secured to said inner housing.

22. The connection device according to claim 1, characterized in that an abutment end of said inner housing which faces away from said tubular member is designed as an abutment for said other member that is inserted at least in part into said connection device.

23. The connection device according to claim 1, characterized in that said clamp ring comprises radially inwardly projecting toothed rings which are in engagement with corresponding tooth receiving recesses of said inner housing and/or of said other member or can be brought into engagement by the action of said deflecting bushing.

24. The connection device according to claim 1, characterized in that a mechanical coupling means is provided for synchronizing rotary movements of three or more rotatable spindles.

25. The connection device according to claim 1, characterized in that a pinion is particularly arranged on the drive end of said rotatable spindle that is in engagement with a gear supported on said inner housing.

* * * * *